US011098950B2

(12) United States Patent
Golubev

(10) Patent No.: US 11,098,950 B2
(45) Date of Patent: Aug. 24, 2021

(54) PROCESS FOR OBTAINING ONE OR MORE AIR PRODUCTS AND AIR SEPARATION PLANT

(71) Applicant: LINDE AKTIENGESELLSCHAFT, Munich (DE)

(72) Inventor: Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 231 days.

(21) Appl. No.: 15/995,742

(22) Filed: Jun. 1, 2018

(65) Prior Publication Data

US 2018/0347900 A1 Dec. 6, 2018

(30) Foreign Application Priority Data

Jun. 2, 2017 (EP) ..... 17020238

(51) Int. Cl.
*F25J 3/04* (2006.01)

(52) U.S. Cl.
CPC ..... *F25J 3/04915* (2013.01); *F25J 3/0406* (2013.01); *F25J 3/0409* (2013.01);
(Continued)

(58) Field of Classification Search
CPC ..... F25J 3/0429; F25J 3/04339–04345; F25J 3/04678; F25J 3/04296; F25J 3/04109;
(Continued)

(56) References Cited

U.S. PATENT DOCUMENTS 3,731,495 A * 5/1973 Coveney ..... F25J 3/04127 62/651
4,962,646 A * 10/1990 Rathbone ..... F25J 3/0409 60/801

(Continued)

FOREIGN PATENT DOCUMENTS

EP 2963367 A1 * 1/2016 ..... F25J 3/04024
EP 3101374 A2 12/2016

OTHER PUBLICATIONS

European Search Report for EP17020238 dated Dec. 11, 2017.

*Primary Examiner* — Frantz F Jules
*Assistant Examiner* — Webeshet Mengesha
(74) *Attorney, Agent, or Firm* — Millen White Zelano & Branigan, PC; Brion P. Heaney

(57) ABSTRACT

The invention proposes a process and an air separation plant comprising a rectification column system comprising a high-pressure column, a low-pressure column, a main heat exchanger, and a main air compressor. The total air supplied to the rectification column system is compressed in the main air compressor to a first pressure level. The high-pressure column is operated at a second pressure level, at least 3 bar below the first pressure level. A gaseous, nitrogen-rich fluid is removed from the high-pressure column and warmed up in the gaseous state without prior liquefaction. A first partial quantity of the gaseous, nitrogen-rich fluid is warmed to a first temperature level of −150 to −100° C., supplied at this first temperature level to a booster and compressed further to a third pressure level. The first partial quantity is then warmed to a second temperature level and discharged from the air separation plant.

19 Claims, 4 Drawing Sheets

(52) U.S. Cl.
CPC ..... *F25J 3/04024* (2013.01); *F25J 3/04084* (2013.01); *F25J 3/04109* (2013.01); *F25J 3/04175* (2013.01); *F25J 3/04296* (2013.01); *F25J 3/04351* (2013.01); *F25J 3/04381* (2013.01); *F25J 3/04393* (2013.01); *F25J 3/04412* (2013.01); *F25J 3/04666* (2013.01); *F25J 3/04678* (2013.01); *F25J 3/04727* (2013.01); *F25J 2200/92* (2013.01); *F25J 2215/54* (2013.01); *F25J 2230/20* (2013.01); *F25J 2240/04* (2013.01); *F25J 2240/46* (2013.01)

(58) Field of Classification Search
CPC .... F25J 2245/40; F25J 2270/40; F25J 3/0406; F25J 3/04351; F25J 3/04078; F25J 3/04084
See application file for complete search history.

(56) References Cited

U.S. PATENT DOCUMENTS

| | | | | |
|---|---|---|---|---|
| 5,475,980 | A | 12/1995 | Grenier et al. | |
| 5,966,967 | A * | 10/1999 | Agrawal | F25J 3/04054 62/646 |
| 6,185,960 | B1 * | 2/2001 | Voit | F25J 3/04018 62/656 |
| 10,018,414 | B2 * | 7/2018 | Musicus | F25J 3/0406 |
| 2004/0221612 | A1 | 11/2004 | Jaouani et al. | |
| 2010/0024478 | A1 * | 2/2010 | Corduan | F25J 3/04357 62/643 |
| 2016/0356547 | A1 | 12/2016 | Goloubev | |

* cited by examiner

PROCESS FOR OBTAINING ONE OR MORE AIR PRODUCTS AND AIR SEPARATION PLANT

The invention relates to a process for obtaining one or more air products and to an air separation plant according to the preambles of the independent patent claims.

PRIOR ART

The production of air products in a liquid or gaseous state by cryogenic separation of air in air separation plants is known and described for example in H.-W. Häring (Ed.), Industrial Gases Processing, Wiley-VCH, 2006, in particular section 2.2.5, "Cryogenic Rectification".

Air separation plants have rectification column systems which can for example take the form of two-column systems, in particular classic Linde double-column systems, but also three- or multi-column systems. In addition to the rectification columns for obtaining nitrogen and/or oxygen in a liquid and/or gaseous state, that is to say the rectification columns for nitrogen-oxygen separation, it is also possible to provide rectification columns for obtaining other air components, in particular the noble gases krypton, xenon and/or argon.

The rectification columns of the rectification column systems mentioned are operated at different pressure levels. Double-column systems have a so-called high-pressure column (also referred to as the pressure column, medium-pressure column or lower column) and a so-called low-pressure column (also referred to as the upper column). The pressure level of the high-pressure column is for example 4 to 6 bar, preferably approximately 5.5 bar. The low-pressure column is operated at a pressure level of for example 1.3 to 1.7 bar, preferably approximately 1.5 bar. The pressure levels specified here and below are in each case absolute pressures at the top of the columns respectively mentioned. The values mentioned are merely given as examples, which can be changed as and when required.

So-called main air compressor/booster air compressor (MAC-BAC) processes or so-called high air pressure (HAP) processes may be used for the air separation. The main air compressor/booster air compressor processes are the rather more conventional processes, while high air pressure processes have recently been used increasingly as alternatives.

Main air compressor/booster air compressor processes are distinguished by the fact that only a part of the total feed air quantity supplied to the rectification column system is compressed to a pressure level which lies significantly, that is to say at least 3, 4, 5, 6, 7, 8, 9 or 10 bar, above the pressure level of the high-pressure column. A further part of the feed air quantity is only compressed to the pressure level of the high-pressure column or to a pressure level that differs by more than 1 to 2 bar from the pressure level of the high-pressure column, and is fed into the high-pressure column at this lower pressure level. An example of a main air compressor/booster air compressor process is shown by Häring (see above) in FIG. 2.3A.

In the case of a high air pressure process, on the other hand, the total feed air quantity supplied to the rectification column system is compressed to a pressure level which lies significantly, that is to say at least 3, 4, 5, 6, 7, 8, 9 or 10 bar, above the pressure level of the high-pressure column. The difference in pressure may be for example up to 14, 16, 18 or 20 bar. High air pressure processes are known for example from EP 2 980 514 A1 and EP 2 963 367 A1.

The present invention is used in particular in the case of air separation plants with so-called internal compression (IC). This involves forming at least one product that is provided by means of the air separation system by removing a cryogenic liquid from the rectification column system, subjecting it to a pressure increase and transforming it into the gaseous or supercritical state by warming it up. For example, in this way internally compressed gaseous oxygen (GOX IV, GOX IC) or nitrogen (GAN IV, GAN IC) can be generated. The internal compression offers a series of advantages over an alternatively likewise possible external compression, and is explained for example by Häring (see above), section 2.2.5.2, "Internal Compression". Internal compression processes are also disclosed for example in US 2004/0221612 A1 and U.S. Pat. No. 5,475,980 A.

On account of significantly lower costs and comparable efficiency, high air pressure processes can represent an advantageous alternative to the conventional main air compressor/booster air compressor processes. However, this does not apply in all cases. The present invention therefore addresses the problem of making it possible for a high air pressure process to be advantageously used at least in some such cases.

DISCLOSURE OF THE INVENTION

This problem is solved by a process for obtaining one or more air products and an air separation plant with the features of the independent patent claims. Configurations are respectively the subject of the dependent patent claims and of the description which follows.

First, there follows an explanation of some of the principles of the present invention and a definition of terms used for describing the invention.

In the context of this application, a "feed air quantity", or "feed air" for short, is understood as meaning the air supplied in total to the rectification column system of an air separation plant, and consequently all of the air supplied to the rectification column system. As already explained above, in a main air compressor/booster air compressor process only a part of a corresponding feed air quantity is compressed to a pressure level which lies significantly above the pressure level of the high-pressure column. On the other hand, in a high air pressure process the total feed air quantity is compressed to such a high pressure level. For the meaning of the term "significantly" in connection with main air compressor/booster air compressor and high air pressure processes, reference should be made to the explanations given above.

A "cryogenic" liquid is understood here as meaning a liquid medium of which the boiling point lies significantly below the ambient temperature, for example at −50° C. or less, in particular at −100° C. or less. Examples of cryogenic liquids are liquid air, liquid oxygen, liquid nitrogen, liquid argon or liquids that are rich in the compounds mentioned.

For the devices and apparatuses that are used in air separation plants, reference should be made to specialist literature, such as Häring (see above), in particular section 2.2.5.6 "Apparatus". For purposes of illustration and clearer delimitation, there follows a more detailed explanation of some of the aspects of corresponding devices.

Multi-stage turbo compressors, which are referred to here as "main air compressors", are used in air separation plants for compressing the feed air quantity. The mechanical construction of turbo compressors is known in principle to a person skilled in the art. In a turbo compressor, the medium to be compressed is compressed by means of turbine blades which are arranged on an turbine wheel or directly on a shaft. In that context, a turbo compressor forms a structural unit which in the case of a multi-stage turbo compressor can however have multiple compressor stages. A compressor stage generally comprises a turbine wheel or a corresponding arrangement of turbine blades. All of these compressor stages can be driven by a common shaft. It may however also be envisaged to drive the compressor stages in groups with different shafts, it also being possible for the shafts to be connected to one another by way of gear mechanisms.

The main air compressor is also distinguished by the fact that the total quantity of air fed into the rectification column system and used for producing air products, that is to say the total feed air, is compressed by this compressor. Correspondingly, a "booster air compressor" may also be provided, in which however only a part of the quantity of air compressed in the main air compressor is brought to a still higher pressure. This may also be formed as a turbo compressor. Further turbo compressors, also referred to here as boosters, are typically provided for the compression of partial quantities of air, but they only perform compression to a relatively small extent in comparison with the main air compressor or the booster air compressor. Also in a high air pressure process there may be a booster air compressor, but this then compresses a partial quantity of the air from a correspondingly higher pressure level.

Furthermore, air may be expanded at a number of points in air separation plants, for which purpose expansion machines in the form of turbo expanders, also referred to here as "expansion turbines", may be used inter alia. Turbo expanders can also be coupled to turbo compressors and drive them. If one or more turbo compressors are driven without externally supplied energy, i.e. only by one or more turbo expanders, the term "turbine booster" is also used for such an arrangement. In a turbine booster, the turbo expander (the expansion turbine) and the turbo compressor (the booster) are mechanically coupled, it being possible for the coupling to take place with the same rotational speed (for example by way of a common shaft) or with different rotational speeds (for example by way of an intermediate gear mechanism). A booster may however in principle also be driven by using external energy, for example by using an electric motor. Within the scope of the present invention, as also still to be explained in detail below, turbine boosters and boosters driven by using external energy can be used.

In the context of the language used here, liquid or gaseous fluids or also fluids that are in a supercritical state may be rich or poor in one or more components, wherein "rich" may represent a content of at least 75%, 90%, 95%, 99%, 99.5%, 99.9% or 99.99% and "poor" may represent a content of at most 25%, 10%, 5%, 1%, 0.1% or 0.01% on a molar, weight or volume basis. The term "predominantly" may correspond to the definition just given of "rich", but refers in particular to a content of more than 90%. If reference is made here for example to "nitrogen", a pure gas or else a gas rich in nitrogen may be concerned.

The terms "pressure level" and "temperature level" are used hereinafter for characterizing pressures and temperatures, these being intended to express that pressures and temperatures need not be used in the form of exact pressure/temperature values to realize an inventive concept. However, such pressures and temperatures typically vary within particular ranges of, for example, ±1%, 5%, 10%, 20% or even 50% around a mean value. It is possible here for different pressure levels and temperature levels to lie in disjoint ranges or in overlapping ranges. In particular, pressure levels for example include unavoidable or expected pressure losses, for example owing to cooling effects. The same holds for temperature levels. Pressure levels reported here in bar are absolute pressures.

Advantages of the Invention

Within the scope of the present invention, a low-cost and at the same time efficient high air pressure process is provided. As already explained at the beginning, such high air pressure processes in some cases represent a good alternative to conventional main air compressor/booster air compressor processes. The present invention relates here for example to a process in which around 37 000 standard cubic meters of compressed gaseous oxygen per hour at 31 bar, 20 000 standard cubic meters of gaseous nitrogen per hour at 10 bar, 3000 standard cubic meters of liquid nitrogen per hour and 3300 standard cubic meters of liquid oxygen per hour can be formed, with simultaneous argon production.

In principle, various high air pressure processes are known from the prior art. These are often classified and differentiated on the basis of the liquid output of the plant or on the basis of the ratio of internally compressed products to liquid products. With a liquid output that is not all that high, as also considered within the scope of the present invention, a so-called cold booster is for example used in order to increase the efficiency of the process by converting excess cold power into higher air pressure. In a corresponding cold booster, conventionally a part of the feed air supplied to the air separation plant, which is cooled down to an intermediate temperature level in the main heat exchanger, and possibly already increased in pressure beforehand, is brought to a higher pressure level. An air separation plant with a cold booster is disclosed for example in EP 3 101 374 A2.

In principle, a cold booster is understood here as meaning a booster that is fed with fluid which is at a temperature level which lies significantly below the respective ambient temperature at the location of the air separation plant, in particular significantly below 0° C., −10° C., −20° C., −30° C., −40° C. or −50° C. or even below that. It is possible to increase the efficiency of the process by a cold booster because the comparatively reduced liquid output means that a corresponding amount of cold is not "extracted" from the system, as would be the case if corresponding products were in a liquid form. A cold booster for use in the present invention may be designed as a turbine booster or as a booster driven by external energy.

It is also known furthermore that the kF value (that is to say the product of the heat transfer coefficient k and the heat exchanger surface area F) of the main heat exchanger of an air separation plant can be increased by the use of a cold booster. This is attributable to the fact that the power taken up during the cold compression in the cold booster is dissipated virtually completely in the main heat exchanger itself. As a result, although the internal compression process or the Q-T profile in the heat exchanger is improved, the required exchange surface area becomes greater, since the amount of compressed gas in a certain temperature range is cooled virtually twice For purposes of illustration, reference should be made for example to FIG. 1 of the already mentioned EP 3 101 374 A2. There, because of the temperature increase as a result of the compression, the stream of matter i is removed from the main heat exchanger 7 before the pressure increase in the cold booster 101 at a lower temperature level than that at which it is returned thereafter to the main heat exchanger 7. From a thermodynamic perspective, the improvement in the Q-T profile is attributable to the increase in the difference in the heat capacities of the cold and warm streams in this temperature range.

An improvement in the efficiency of high air pressure processes by the use of a number of throttle streams at different pressures is likewise known. In this context, a "throttle stream" is a part of the feed air quantity that is cooled down at a pressure level above the operating pressure of the high-pressure column in the main heat exchanger, at least partially liquefied or transformed at a corresponding pressure in the gaseous state to the supercritical state and subsequently relaxed by means of an expansion device, classically an expansion valve ("throttle"), and supplied to the rectification column system, in particular the high-pressure column.

A pressurized nitrogen product at for example around 10 bar may for example be provided by booster compression, in particular as pressurized nitrogen from the high-pressure column operating at around 5.5 bar or by internal compression. In the first case, a separate compressor is required, in the latter case an internal compression pump and a still greater heat exchanger.

Within the scope of the present invention, the problem explained at the beginning, that of providing a low-cost and nevertheless efficient HAP process, is thus solved by providing that, instead of a cold compression of a feed air stream for improving the Q-T profile in the main heat exchanger, as known in principle from the prior art, a stream of nitrogen from the high-pressure column is to be compressed in a cold state in a turbine booster or a booster driven by external energy. This is configured and developed in a particularly advantageous way within the scope of the present invention.

The pressure ratios of cold boosters are typically a maximum of 1.9 to 2. A pressure ratio is in this case defined as the ratio of the input pressure to the output pressure of a corresponding booster. This pressure ratio is sufficient to deliver the required quantity of nitrogen product, in the present case at around 10 bar. Therefore, a cold booster can be advantageously used for providing pressurized nitrogen at a corresponding pressure level.

By using a cold booster for a corresponding nitrogen product stream, in principle the same effect can be achieved as by cold compression in the cold booster and subsequent cooling of a partial stream of the feed air. The improvement in the Q-T profile is in this case likewise achieved by the more favourable ratio of the heat capacities between the cold and warm streams. By contrast with the known processes, however, there is the difference that, in the case of the configuration proposed within the scope of the present invention, the heat capacity of cold streams is reduced in certain regions of the heat exchanger (by diverting a corresponding stream of nitrogen to the cold booster). In the case of the booster compression of air that is usual in the prior art, on the other hand, the heat capacity of warm streams is increased by the cold-compressed air stream being passed through the heat exchanger twice. The difference described has a positive effect on the kF value of the heat exchanger. This is reduced within the scope of the present invention, since the power of the cold booster for the pressurized nitrogen does not have to be dissipated in the main heat exchanger (the stream of pressurized nitrogen warms up as a result of the compression and is subsequently fed back into the main heat exchanger at a suitable point for subsequent warming up to almost ambient temperature).

The present invention comprises in addition to the cold compression of a pressurized nitrogen product also the particularly advantageous balancing out of the excess cold power in the process as a whole and the power of the cold booster. This can be achieved by providing that, in a particularly preferred embodiment of the invention, in addition to the product quantity, a certain additional quantity of pressurized nitrogen from the high-pressure column is also compressed at the same time and subsequently used as an additional throttle stream in the main heat exchanger. A corresponding additional quantity of pressurized nitrogen is therefore at least partially liquefied in the main heat exchanger and fed again into the rectification column system, in particular the high-pressure column.

In this way, almost the entire power of the cold booster is exhausted and the Q-T profile in the heat exchanger is improved by an additional throttle stream. In a certain sense, this configuration represents a combination of the two described methods for improving the Q-T profile. The use of an additional nitrogen throttle stream also has a positive effect on the product yield, since in this way less air is pre-liquefied (instead of feed air, pressurized nitrogen from the high-pressure column is liquefied).

A corresponding adaptation of the rectification, as mentioned once again below, is also of significance here. To be able to remove more pressurized nitrogen from the pressure column without the argon yield deteriorating, the low-pressure column should be argon-optimized, that is to say configured with an additional rectification section between the feeding-in points of the argon condensers, when for example crude and pure argon columns or argon discharge columns are used. The quantity of the additional nitrogen throttle stream in this case represents an parameter for optimization. All of the nitrogen that is removed from the high-pressure column and neither condensed and recycled as reflux into said high-pressure column nor condensed and used as liquid reflux into the low-pressure column (as is the case here) fundamentally impairs the separation in the low-pressure column, because it is no longer available there as reflux.

Altogether, the present invention proposes a process for obtaining one or more air products by using an air separation plant with a rectification column system which comprises a high-pressure column and a low-pressure column, and which is also equipped with a main heat exchanger and a main air compressor. As already mentioned, the present invention is used in conjunction with a high air pressure process, therefore the total air supplied to the rectification column system is compressed in the main air compressor to a first pressure level and the high-pressure column is operated at a second pressure level, which is at least 3 bar below the first pressure level. For further typical pressure differences, reference should be made expressly to the explanations given in the introduction.

Furthermore, as known in principle, within the scope of the present invention a gaseous, nitrogen-rich fluid is removed from the high-pressure column at the second pressure level and warmed up in the gaseous state without prior liquefaction. In conventional air separation plants, this fluid is pressurized nitrogen, which is to be removed from the air separation plant as a product of the process. Conventionally, such a nitrogen-rich fluid is completely warmed in the main heat exchanger and is subsequently given off as a corresponding product. If reference is made here to a corresponding fluid being warmed up in the gaseous state "without prior liquefaction", this should be understood as meaning that a corresponding fluid is not such nitrogen that is removed from the high-pressure column, liquefied in a main condenser connecting the high-pressure column and the low-pressure column in a heat-exchanging manner and subsequently for example returned to the high-pressure column or fed into the low-pressure column. Such a fluid can in principle also be warmed, or for example serve for providing liquid nitrogen. Corresponding fluids may also be used within the scope of the present invention (but in addition to the fluid that is warmed up in the gaseous state without prior liquefaction).

It is in this respect envisaged within the scope of the present invention to warm up a first partial quantity of the gaseous, nitrogen-rich fluid to a first temperature level of −150 to −100° C., in particular of −140 to −120° C., for example −130° C., supply it at this first temperature level to a booster, and by using the booster compress it further to a third pressure level. Because of the temperature levels at which the gaseous, nitrogen-rich fluid and the first partial quantity of this fluid are supplied to the booster, the booster is a "cold booster" in the sense explained above. As already explained, this booster may be designed as a turbine booster or as a booster driven by means of external energy. The advantages of using a cold booster have likewise already been mentioned above. The third pressure level lies in particular at a pressure level at which a corresponding nitrogen product is to be given off, for instance at a pressure of 8 to 12 bar, in particular of 9 to 11 bar, for example 10 bar. Such a pressure level is therefore the pressure in which a corresponding nitrogen-rich pressurized product is given off.

It is also envisaged within the scope of the present invention to warm up the first partial quantity after compression to the third pressure level to a second temperature level above the first temperature level, which may in particular be at ambient temperature, and to discharge it permanently from the air separation plant. The corresponding first partial quantity is therefore provided as pressurized product.

According to a particularly advantageous embodiment of the present invention, it is also envisaged to warm up a second partial quantity of the gaseous, nitrogen-rich fluid together with the previously already mentioned first partial quantity likewise to the first temperature level, supply it at this first temperature level to the booster, and by using the booster compress it further to the third pressure level. However, it is envisaged here to cool down the second partial quantity after compression to the third pressure level to a third temperature level below the first temperature level, subsequently expand it to the second pressure level and return it to the high-pressure column. In this case, during the cooling down to the third temperature level, the second partial quantity is in particular at least partially liquefied or transformed from the supercritical state into the liquid state. Therefore, in this case, as mentioned, a partial quantity (to be specific the second partial quantity) of the pressurized nitrogen compressed in the cold booster is used as a further throttle stream. The third temperature level may be a temperature level of −180 to −165° C., in particular of −177 to −167° C., for example −172° C.

It is furthermore also possible within the scope of the present invention to warm up a third partial quantity of the nitrogen-rich fluid without compression to the third pressure level to the first temperature level and to discharge it permanently from the air separation plant. Corresponding nitrogen may for example be provided in the form of so-called seal gas or as a nitrogen product at a lower pressure level. The first, second and third partial quantities preferably together form the total quantity of the nitrogen-rich fluid that is removed from the high-pressure column and not liquefied.

It is particularly advantageous if, within the scope of the present invention, the first and second partial quantities are warned up to the first temperature level by using the main heat exchanger, and/or if the first partial quantity is warmed up to the second temperature level by using the main heat exchanger and/or if the second partial quantity is cooled down to the third temperature level by using the main heat exchanger. As already explained, in this way the Q-T profile and the kF value of the main heat exchanger can be influenced in a particularly favourable way.

As mentioned, in one configuration of the present invention, the booster used for compressing the cold nitrogen stream, that is to say the cold booster, is coupled to an expansion turbine, and therefore represents a turbine booster. It is particularly advantageous here if, in the expansion turbine coupled to the booster, a part of the air which is supplied to the rectification column system and has previously been cooled down to a fourth temperature level by using the main air compressor and is subsequently fed into the high-pressure column is expanded to the second pressure level. The fourth temperature level may in this case lie at −170 to −120° C., in particular at −160 to −130° C., for example −149° C.

The expansion of part of the air that is supplied to the rectification system in an expansion turbine for the purpose of driving the cold booster may in principle also take place to approximately the pressure level of the low pressure column, with subsequent introduction of this stream into the low-pressure column. In certain cases, it may also be advisable to remove a further stream of nitrogen at the second pressure level from the high-pressure column, warm it up to a certain temperature level in the heat exchanger and expand it in an expansion turbine for the purpose of driving the cold compressor.

As an alternative to this, the cold booster may also be driven by using external energy, that is say not in the form of energy that is stored in a process stream provided in the air separation plant. In particular, an electric motor may be used for driving the cold booster.

It is particularly advantageous if the second partial quantity comprises a fraction, in particular a normalized quantitative fraction, for example expressed in standard cubic meters per hour, of 0 to 60%, in particular of 10 to 50%, for example of 15 to 35%, of the gaseous nitrogen-rich fluid that is removed from the high-pressure column at the second pressure level and warmed up in the gaseous state without prior liquefaction. As mentioned, in this way the capacity of a corresponding plant can be utilized almost completely.

It is particularly advantageous if a part of the air that is supplied to the rectification column system is compressed in a further booster from the first pressure level to a fifth pressure level of 20 to 30 bar, in particular of 22 to 27 bar, for example 25 bar, cooled down to a fifth temperature level by using the main heat exchanger, expanded to the second pressure level in an expansion turbine mechanically coupled to the further booster, and subsequently fed into the high-pressure column. Such a procedure using a so-called warm booster can in this case correspond in principle to the prior art and underpins the advantages that can be achieved within the scope of the present invention.

In the case of such a configuration, it proves to be particularly advantageous if a part of the air that is supplied to the rectification column system is compressed from the first pressure level to the fifth pressure level in the further booster, cooled down to a sixth temperature level, which lies for example at −165 to −115° C., in particular at −150 to −130° C., for example −141° C., by using the main heat exchanger, expanded to the second pressure level, and subsequently fed into the high-pressure column. Also in this way, the advantages that can be achieved within the scope of the present invention can be further enhanced.

Particular advantages are also achieved if a part of the air that is supplied in liquid form to the rectification column system is cooled down at the first pressure level by using the main heat exchanger, expanded from the first pressure level to the second pressure level, and subsequently fed into the high-pressure column. For the particular advantages of such a configuration, reference should be made to the explanations given above.

In particular, within the scope of the present invention, the rectification column system comprises at least one rectification column, into which a first fluid that is enriched in argon with respect to a sump liquid of the high-pressure column is transferred from the low-pressure column, and in which the first fluid is depleted of argon. A residue of the first fluid that remains after the argon depletion is in this case returned into the low-pressure column in the form of a second fluid. The present invention may in this case be used in principle by using known crude and possibly pure argon columns, but it is also possible for argon to be purely discharged, without obtaining an argon product, by using so-called argon discharge columns.

The advantageous effect of the argon discharge from the fluid separated in the low-pressure column thereby achieved is attributable to the fact that the oxygen-argon separation is no longer necessary in the low-pressure column for the discharged argon quantity. The separating-off of the argon from the oxygen in the low-pressure column is itself complex in principle and demands a corresponding "heating" power of the main condenser. If argon is discharged and thus the oxygen-argon separation is eliminated, or if said oxygen-argon separation is relocated for example into a crude argon column or argon discharge column, the corresponding argon quantity no longer needs to be separated off in the oxygen section of the low-pressure column, and the heating power of the main condenser can be reduced. Therefore, with the oxygen yield remaining the same, more pressurized nitrogen can be removed from the high-pressure column, which is specifically desired within the scope of the present invention.

In a conventional crude argon column, crude argon can be obtained and prepared in a downstream pure argon column to form an argon product. By contrast, an argon discharge column serves primarily for argon discharge for the purpose explained above. An "argon discharge column" may in principle be understood as meaning a separating column for argon-oxygen separation which does not serve for obtaining a pure argon product but for discharging argon from the air to be separated in the high-pressure column and low-pressure column. Its interconnection differs only slightly from that of a classic crude argon column, but it contains significantly fewer theoretical trays, specifically fewer than 40, in particular between 15 and 30. Like a crude argon column, the sump region of an argon discharge column is connected to an intermediate point of the low-pressure column, and the argon discharge column is cooled by a top condenser, on the evaporation side of which typically expanded sump liquid from the high-pressure column is introduced. An argon discharge column typically has no sump evaporator.

It is particularly advantageous here if a crude argon column and a pure argon column are used, respectively operated with a top condenser in which oxygen-enriched liquid from the sump of the high-pressure column, which in particular is previously passed through a counter-current subcooler, is partially evaporated. A non-evaporated fraction is in this case respectively fed in liquid form into the low-pressure column. The feeding-in of the non-evaporated fraction from the top condenser of the pure argon column advantageously takes place here 5 to 15 theoretical separating stages above the feeding-in of the non-evaporated fraction from the top condenser of the crude argon column and the latter once again above the removal of the first fluid and the feeding back of the second fluid. In this way, an "argon-optimized" separation can be achieved, making it possible for a greater quantity of nitrogen-rich fluid to be correspondingly removed from the high-pressure column.

The present invention also relates to a plant for obtaining one or more air products, with respect to the features of which reference is made to the corresponding independent patent claim.

For features and advantages of the air separation plant proposed according to the invention, reference should be made expressly to the explanations given above with respect to the process proposed according to the invention. The same also applies correspondingly to an air separation plant set up for carrying out a process such as that explained above in detail, and having corresponding means for this.

The invention is explained in more detail below with reference to the appended drawings, which illustrate preferred embodiments of the present invention.

DETAILED DESCRIPTION OF THE DRAWING

Figure 1:
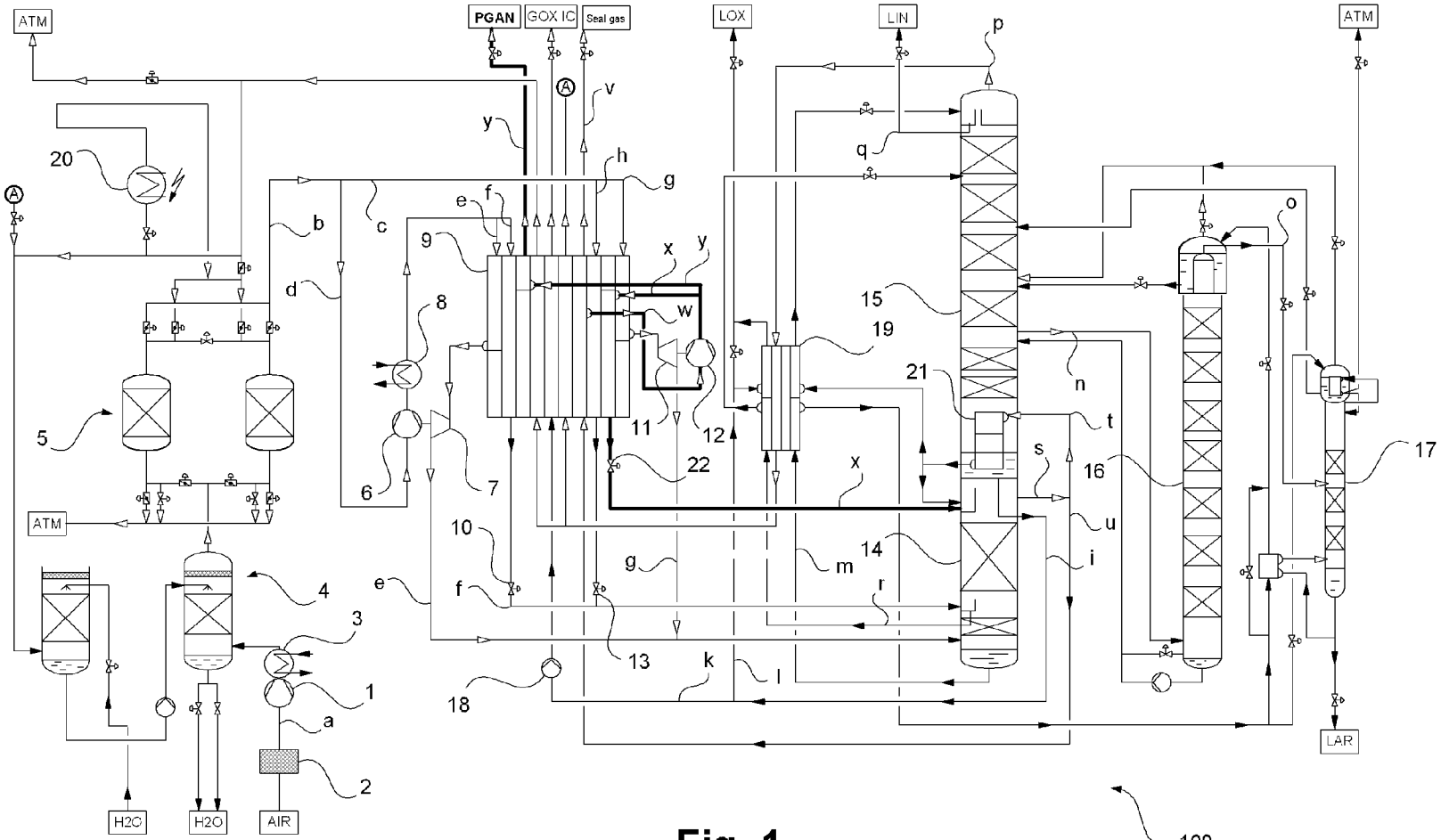
FIG. 1 shows an air separation plant according to one embodiment of the invention in a schematic representation.

In FIG. 1, an air separation plant according to one embodiment of the invention is shown in a simplified, schematic representation and is denoted by 100.

In the air separation plant 100, a feed air stream a (AIR) is drawn in by means of a main air compressor 1 via a filter 2 and compressed to a pressure level which is referred to here as the first pressure level. The main air compressor 1 may be designed in particular in multiple stages with intermediate cooling. A cooler assigned to the main air compressor 1 is shown as representative of a number of corresponding coolers and is denoted by 3.

The air separation process carried out in the air separation plant 100 is a high air pressure process explained above, so that the first pressure level lies at least 3 bar above a pressure level at which a high-pressure column 14 of a rectification column system (see below) of the air separation plant 100 is operated, and which is referred to here as the second pressure level.

The total quantity of air fed to the rectification column system, which is compressed to the first pressure level, is referred to here as the feed air quantity. This feed air quantity is first cooled in the form of the feed air stream a in a cooling device 4, and subsequently freed at least largely of water and carbon dioxide in an adsorption device 5. With respect to the operating principle of the cooling device 4 and the adsorption device 5, reference should be made to specialist literature such as Häring (see above). The cooling device 4 is operated in the way described with cooling water (H2O); the adsorption device 5 is regenerated with regenerating gas, which after its use can be given off to the atmosphere (ATM). The cooled and purified feed air stream a, which to allow better differentiation is thus denoted by b, is first divided into two partial streams c and d.

The partial stream c is brought to a pressure level above the first pressure level in a booster 6, which is mechanically coupled to an expansion turbine 7, and after cooling in an aftercooler is once again divided into two partial streams e and f, which are supplied to a main heat exchanger 9 of the air separation plant 100. Since the partial stream e is supplied to the booster 6 at ambient temperature or above, but at least at a temperature level above 0° C., it is also referred to as a warm booster. The partial stream e is removed from the main heat exchanger 9 at an intermediate temperature level, expanded in the expansion turbine 7 and fed into the high-pressure column 14 in an at least partially gaseous state. The partial stream f is removed from the main heat exchanger 9 on the cold side and fed into the high-pressure column 14 in a liquid state via a throttle 10. The partial stream f is therefore a first throttle stream.

The partial stream c is likewise divided once again into two partial streams g and h, which are supplied to the main heat exchanger 9 of the air separation plant 100. The partial stream g is removed from the main heat exchanger 9 at an intermediate temperature level, expanded in an expansion turbine 11, which is mechanically coupled to a booster 12, and fed into the high-pressure column 14 in an at least partially gaseous state. It is in this case previously combined with the partial stream e. Since, as explained below, fluid that is significantly below ambient temperature, but at least significantly below 0° C., −10° C., −20° C., −30° C., −40° C., −50° C., is supplied to the booster 12, it is also referred to as a cold booster. The partial stream h is removed from the main heat exchanger 9 on the cold side and fed into the high-pressure column 14 in a liquid state via a throttle 13. It is in this case previously combined with the partial stream f or fed into the high-pressure column 14 directly. The partial stream h is therefore a second throttle stream.

The operation of the rectification column system, which in the air separation plant 100 comprises the already mentioned high-pressure column 14, a low-pressure column 15, a crude argon column 16 and a pure argon column 17, can in principle be taken from the specialist literature cited at the beginning.

The air separation plant 100 is designed for internal compression. In the example presented, for this purpose an oxygen-rich sump product in the form of a stream of matter i is removed in liquid form from the low-pressure column 15 and a fraction thereof in the form of a stream of matter k is brought to around 30 bar(a) or to a higher pressure level, for example to a supercritical pressure level, in an internal compression pump 18, evaporated or transformed from the liquid state into the supercritical state in the main heat exchanger 9, and given off as an internally compressed oxygen-rich air product (GOX IC) at the periphery of the plant. A further fraction of the stream of matter i is not internally compressed, instead is passed to the periphery of the plant in the form of a stream of matter I and given off there as a liquid oxygen product (LOX). The temperature may in this case be set by partially passing the stream of matter I through a counter-current subcooler 19.

Oxygen-enriched liquid in the form of a stream of matter m can be removed from the sump of the high-pressure column 14. The stream of matter m may be passed through the counter-current subcooler 19 and subsequently fed in fractions into the respective evaporation spaces of the top condensers of the crude argon column 16 and the pure argon column 17. Liquid and gaseous fractions removed from these evaporation spaces are fed into the low-pressure column 15. The crude argon column 16 and the pure argon column 17 are operated in a known way. In particular, an argon-enriched fluid in the form of a stream of matter n is removed at a suitable position from the low-pressure column 15 and in the crude argon column 16 is depleted of oxygen, which is returned into the low-pressure column 15. Nitrogen-containing crude argon is transferred in the form of a stream of matter o into the pure argon column, where in particular nitrogen can be separated off and given off to the atmosphere (ATM). Liquid argon (LAR) may be given off as product at the periphery of the plant.

Gas may be removed from the top of the low-pressure column 15 and passed in the form of a stream of matter p through the counter-current subcooler 19, and subsequently through the main heat exchanger 9 (see also link A), and can be partly used as the already mentioned regenerating gas in the adsorption device 5 after warming up in a heating device 20. It is also possible in principle for it to be given off to the atmosphere (ATM), for example at times in which no regenerating gas is required. A liquid, nitrogen-rich stream of matter q may be drawn off from a tray in an upper region of the low-pressure column 15 and given off as liquid product (LIN) at the periphery of the plant.

Liquid air may be drawn from the high-pressure column 14 in the form of a stream of matter r, passed through the counter-current subcooler 19 and fed into the low-pressure column 15. Nitrogen-rich gas in the form of a stream of matter s may be drawn off from the top of the high-pressure column. This may be partly liquefied in the form of a stream of matter tin a main condenser 21, connecting the high-pressure column 14 and the low-pressure column 15 in a heat-exchanging manner, and used as reflux to the high-pressure column 14, and also be passed through the counter-current subcooler 19 and fed into the low-pressure column 15.

A further aspect of the present invention in the embodiment illustrated is the treatment of the fraction of the stream of matter s that is not passed through the main condenser 21. Since it has been removed from the high-pressure column, it is at the pressure level of the latter, the second pressure level, and in the example represented is supplied to the main heat exchanger 9 on the cold side in the form of a stream of matter u. A partial stream v is removed from the main heat exchanger 9 on the warm side and for example provided as seal gas.

A further partial stream w is removed from the main heat exchanger 9 at an intermediate temperature level, which is referred to here as the first temperature level, and in the already mentioned booster 12 is brought to a pressure level above the second pressure level, which is referred to here as the third pressure level. In turn, a partial stream x of the partial stream w is again supplied to the main heat exchanger 9, removed from it on the cold side, that is to say is cooled down to a temperature level that is referred to here as the third temperature level, expanded in the liquid state via a throttle 22 and returned into an upper region of the high-pressure column 14. The partial stream x is therefore a further throttle stream.

On the other hand, a further partial stream y of the partial stream w is warmed up in the main heat exchanger 9 to a temperature level that is referred to here as the second temperature level, and is given off as a gaseous pressurized nitrogen product at the periphery of the plant.

In other words, here a first partial quantity and a second partial quantity in the form of the streams of matter y and x of a nitrogen-rich fluid that is removed from the high-pressure column 15 in the form of a stream of matter u at the second pressure level and warmed up by using the main heat exchanger 9 are warmed up to the first temperature level by using the main heat exchanger 9, supplied at this temperature level to the booster 12, and compressed further to the third pressure level by using the booster 12. After compression to the third pressure level, the first partial quantity, i.e. the stream of matter y, is warmed up to a second temperature level above the first temperature level by using the main heat exchanger 9 and is permanently discharged from the air separation plant. After compression to the third pressure level, the second partial quantity, i.e. the stream of matter x, is cooled down to the third temperature level by using the main heat exchanger 9, expanded to the second pressure level and returned into the high-pressure column 15.

Figure 2:
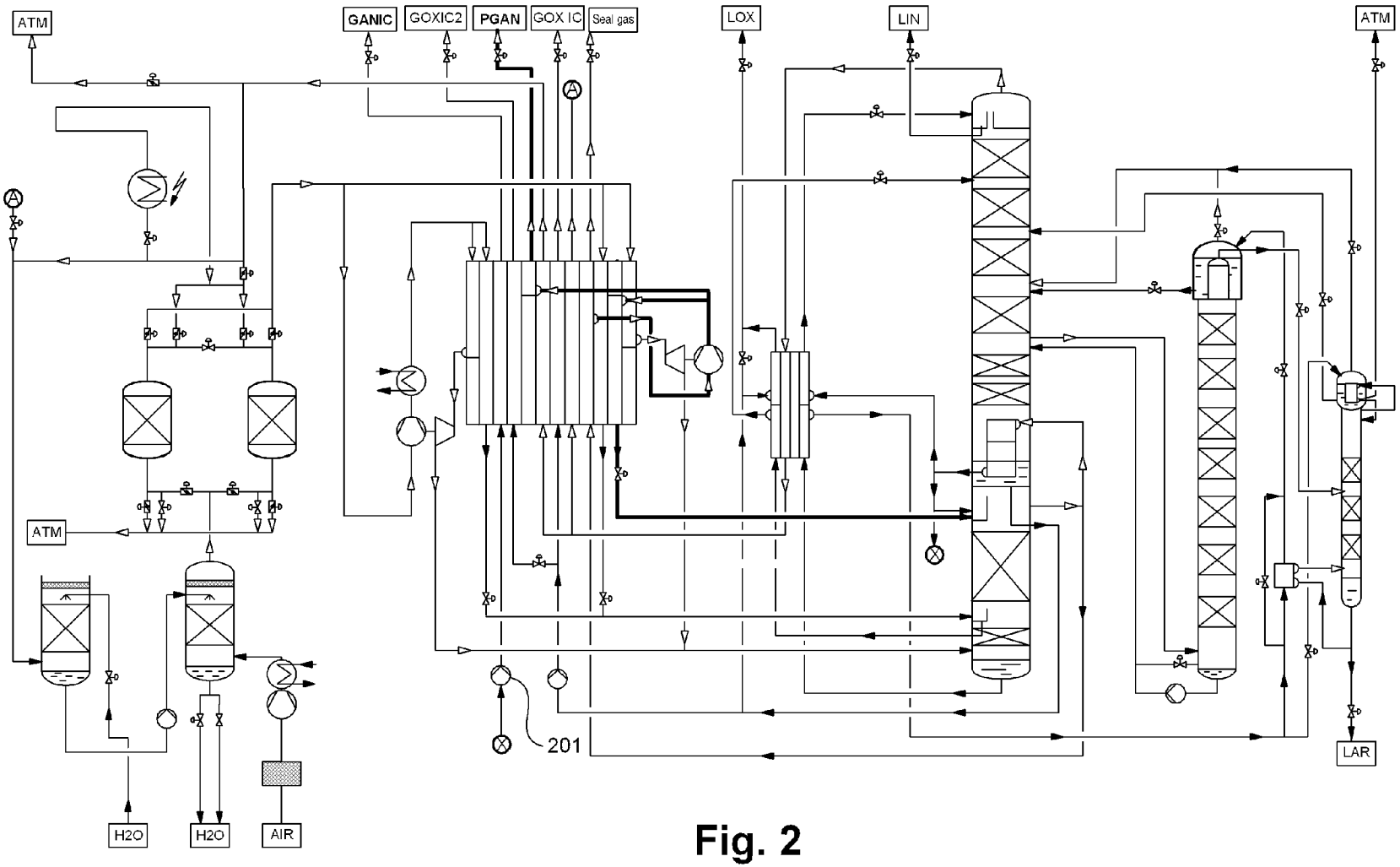
FIG. 2 shows an air separation plant according to one embodiment of the invention in a schematic representation.

FIG. 2 shows an air separation plant according to a further embodiment of the invention in a schematic representation, no description being given of components that have already been explained in relation to FIG. 1. They are also not provided again with designations.

As illustrated in FIG. 2, a part of the nitrogen-rich gas liquefied in the main condenser 21, comparable to the stream of matter k according to plant 100 or FIG. 1 (see link X in FIG. 2), is also compressed by means of a further internal compression pump 201, warmed up in the main heat exchanger 9 and subsequently provided as an internally compressed, gaseous nitrogen product (GAN IC).

Figure 3:
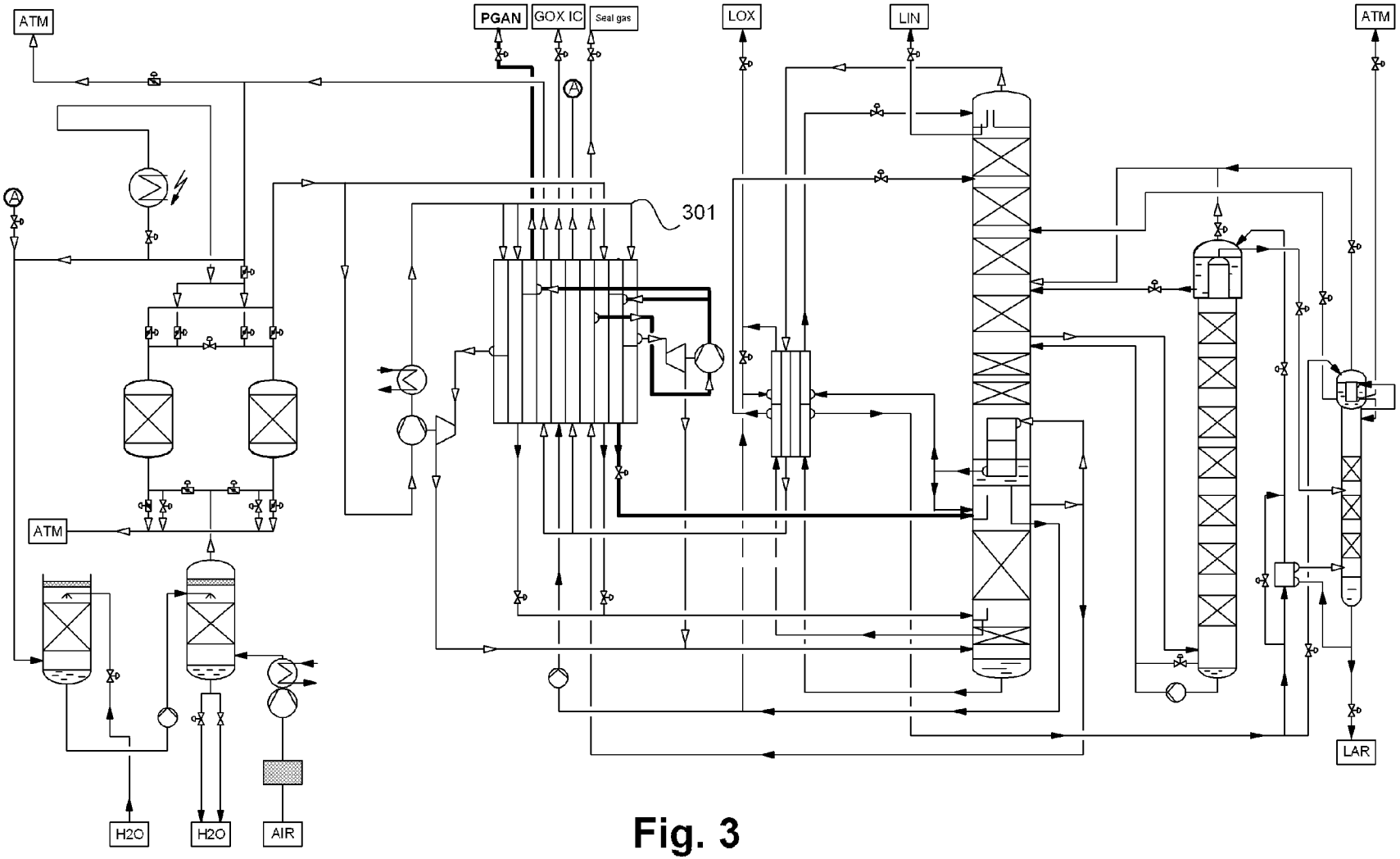
FIG. 3 shows an air separation plant according to one embodiment of the invention in a schematic representation.

FIG. 3 shows an air separation plant according to a further embodiment of the invention in a schematic representation. Once again, no description is given of components that have already been explained in relation to FIG. 1 or 2. They are also not provided again with designations.

As illustrated in FIG. 3, instead of the partial stream g, which is formed by the partial stream c, a further partial stream 301 of the partial stream d, which as a result of the compression in the booster 6 is at a higher pressure level than the partial stream c, may alternatively also be supplied to the expansion turbine 11. The partial stream g is in this case not formed.

Figure 4:
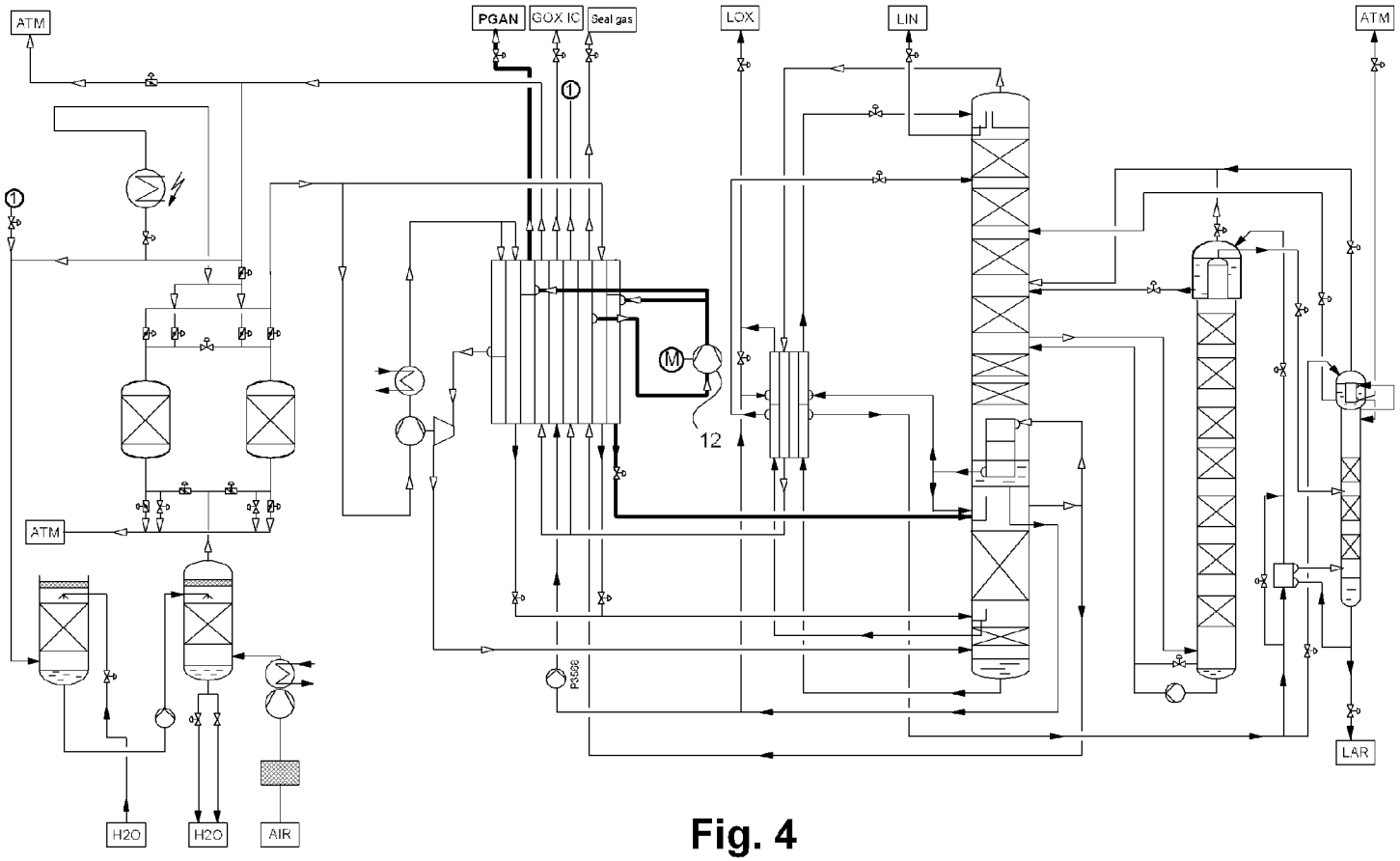
FIG. 4 shows an air separation plant according to one embodiment of the invention in a schematic representation.

FIG. 4 shows an air separation plant according to a further embodiment of the invention in a schematic representation. As before, here too no description is given of components that have already been explained in relation to the previous figures, and they are not provided again with designations here either.

As represented in FIG. 4, the booster 12 may also be driven by using external energy, for example by using an electric motor M. In this way, it is possible to dispense with the separate provision of a stream of matter g (FIG. 1) or 301 (FIG. 3).

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding European application No. 17020238.6, filed Jun. 2, 2017 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for obtaining one or more air products using an air separation plant having a rectification column system comprising a high-pressure column, a low-pressure column, a main heat exchanger, and a main air compressor, said process comprising:

compressing all feed air that is to be supplied to the rectification column system in the main air compressor to a first pressure level, and operating the high-pressure column at a second pressure level which is at least 3 bar below the first pressure level, wherein the feed air to be supplied to the rectification column is cooled and purified before being cooled in the main heat exchanger, removing a gaseous, nitrogen-rich fluid from the high-pressure column at the second pressure level, and warming said gaseous, nitrogen-rich fluid while in the gaseous state without prior liquefaction, wherein a first partial quantity of the gaseous, nitrogen-rich fluid is warmed in the main heat exchanger to a first temperature level of −150 to −100° C., wherein said first partial quantity of the gaseous, nitrogen-rich fluid is supplied at the first temperature level to a booster, in which said first partial quantity of the gaseous, nitrogen-rich fluid is compressed further to a third pressure level, and wherein, after compression to the third pressure level, said first partial quantity of the gaseous, nitrogen-rich fluid is warmed in the main heat exchanger to a second temperature level above the first temperature level and is thereafter discharged permanently from the air separation plant.

2. The process according to claim 1, further comprising warming a second partial quantity of the gaseous nitrogen-rich fluid together with the first partial quantity of the gaseous nitrogen-rich fluid to the first temperature level in said main heat exchanger, supplying said second partial quantity of the gaseous nitrogen-rich fluid at the first temperature level to the booster, compressing said second partial quantity of the gaseous nitrogen-rich fluid to the third pressure level in said booster, cooling the second partial quantity of the gaseous nitrogen-rich fluid, after compression to the third pressure level, to a third temperature level below the first temperature level, and subsequently expanding said second partial quantity of the gaseous nitrogen-rich fluid to the second pressure level and returning said second partial quantity of the gaseous nitrogen-rich fluid to the high-pressure column.

3. The process according to claim 2, wherein a third partial quantity of the nitrogen-rich fluid, which is not compressed to the third pressure level, is warmed to the first temperature level and discharged permanently from the air separation plant.

4. The process according to claim 1, wherein the third pressure level is at 8 to 12 bar.

5. The process according to claim 1, the booster is mechanically coupled to an expansion turbine.

6. The process according to claim 1, wherein the booster is driven by external energy.

7. The process according to claim 2, wherein the second partial quantity is 10 to 50% of the gaseous nitrogen-rich fluid removed from the high-pressure column at the second pressure level and warmed in the gaseous state without prior liquefaction.

8. The process according to claim 1, wherein said main heat exchanger has a cold end and a warm end a first part of the feed air that is to be supplied to the rectification column system is further compressed in a further booster from the first pressure level to a further pressure level, cooled in the main heat exchanger to an intermediate temperature which is between to the temperature at the warm end of the main heat exchanger and the temperature at the warm end of the main heat exchanger, expanded to the second pressure level in an expansion turbine mechanically coupled to the further booster, and subsequently fed into the high-pressure column.

9. The process according to claim 8, wherein a second part of the feed air that is to be supplied to the rectification column system is compressed from the first pressure level to the further pressure level in the further booster, cooled in the main heat exchanger to a temperature below said intermediate temperature, expanded to the second pressure level, and subsequently fed into the high-pressure column.

10. The process according to claim 1, wherein a part of the feed air that is to be supplied to the rectification column system is cooled down at the first pressure level in the main heat exchanger, expanded from the first pressure level to the second pressure level, and subsequently fed into the high-pressure column.

11. The process according to claim 1, wherein the rectification column system comprises at least one rectification column, into which a first fluid that is enriched in argon with respect to a sump liquid of the high-pressure column is transferred from the low-pressure column and depleted of argon, and a residue of the first fluid that remains after argon depletion is returned to the low-pressure column.

12. The process according to claim 11, wherein said rectification column system includes a crude argon column and a pure argon column which provide for argon depletion of the first liquid, said crude argon column and pure argon column are operated with top condensers in which oxygen-enriched liquid from a sump of the high-pressure column is partially evaporated, and a non-evaporated fraction from the top condenser of the pure argon column and non-evaporated fraction from the top condenser of the crude argon column are the residue of the first liquid returned to the low-pressure column, wherein the non-evaporated fraction from the top condenser of the pure argon column is fed into the low-pressure column at a point which is 5 to 15 theoretical separating stages above the point at which the non-evaporated fraction from the top condenser of the crude argon column is fed into the low pressure column.

13. An air separation plant for obtaining one or more air products comprising:

a rectification column system comprising a high-pressure column, a low-pressure column, a main heat exchanger, and a main air compressor, a line for introducing feed air that is to be supplied to the rectification column system into the main compressor wherein feed air that is to be supplied to the rectification column system is compressed to a first pressure level, and wherein the high-pressure column is operated at a second pressure level which is at least 3 bar below the first pressure level, a cooling device for cooling the feed air prior to being supplied to the rectification column system, an adsorption device for removing water and carbon dioxide from the feed air to being supplied to the rectification column system, a line for removing a gaseous, nitrogen-rich fluid from the high-pressure column at the second pressure level, and means for heating gaseous, nitrogen-rich fluid in the gaseous state without prior liquefaction, one or more passages within said main heat exchanger for heating a first partial quantity of the gaseous, nitrogen-rich fluid to a first temperature level of −150 to −100° C., a line for supplying the first partial quantity of the gaseous, nitrogen-rich fluid at the first temperature level to a booster wherein the first partial quantity of the gaseous, nitrogen-rich fluid is compressed to a third pressure level, and one or more further passages within said main heat exchanger for heating the first partial quantity of the gaseous, nitrogen-rich fluid, after compression to the third pressure level, to a second temperature level above the first temperature level and discharging the first partial quantity of the gaseous, nitrogen-rich fluid from the air separation plant.

14. The process according to claim 1, wherein said first partial quantity of the gaseous, nitrogen-rich fluid is warmed up to a first temperature level of −140 to −120° C.

15. The process according to claim 2, wherein the second partial quantity is cooled to the third temperature level in the main heat exchanger.

16. The process according to claim 5, wherein a part of the air supplied to the rectification column system, which has previously been cooled to a fourth temperature level in the main heat exchanger and subsequently fed to the high-pressure column, is expanded to the second pressure level in the expansion turbine coupled to the booster.

17. A process according to claim 6, wherein the booster is driven by an electric motor.

18. The process according to claim 9, wherein a third part of the feed air that is to be supplied to the rectification column system is cooled at the first pressure level in the main heat exchanger, expanded from the first pressure level to the second pressure level, and subsequently fed into the high-pressure column.

19. The process according to claim 13, wherein said means for heating gaseous, nitrogen-rich fluid in the gaseous state without prior liquefaction comprises a passage within said main heat exchanger.

* * * * *